US005240494A

United States Patent [19]

Williams et al.

[11] Patent Number: 5,240,494

[45] Date of Patent: Aug. 31, 1993

[54] METHOD FOR MELTING COPPER

[75] Inventors: Jim D. Williams; Darrell W. Breitling, both of Amarillo, Tex.

[73] Assignee: ASARCO Incorporated, New York, N.Y.

[21] Appl. No.: 691,250

[22] Filed: Apr. 25, 1991

[51] Int. Cl.[5] ..... C22B 9/16

[52] U.S. Cl. ..... 75/376; 75/653; 266/47; 266/79; 431/12

[58] Field of Search ..... 75/376, 653; 431/12; 266/47, 79

[56] References Cited

U.S. PATENT DOCUMENTS 2,413,215 12/1946 Carter et al. ..... 75/376

4,492,559 1/1985 Pocock ..... 431/12

FOREIGN PATENT DOCUMENTS 166638 9/1984 Japan ..... 75/653

*Primary Examiner*—Melvyn J. Andrews

*Attorney, Agent, or Firm*—John J. Tomaszewski; Kenneth A. Koch

[57] ABSTRACT

A method is disclosed for melting copper without incorporating unwanted oxygen and/or hydrogen into the copper by effectively controlling the burners used to melt the copper within desired fuel/air ratio operating limits by employing a special fuel/air mixture sampling and control system.

5 Claims, 2 Drawing Sheets

METHOD FOR MELTING COPPER

BACKGROUND OF THE INVENTION

This invention relates to a method for controlling the operation of a burner and, more particularly, to controlling the fuel/air ratio of burners used to melt copper to avoid incorporating unwanted oxygen and/or hydrogen into the copper.

The melting of copper is a very important commercial process. As is well-known in the art and as discussed in U.S. Pat. No. 3,199,977 issued to A. J. Phillips et al. on Aug. 10, 1965, the disclosure of which is incorporated by reference, copper cathodes are the predominant form of copper produced industrially and the cathodes are generally flat rectangular shapes about one inch thick by about 25 inches to 40 inches, although larger or smaller sizes may be produced.

Although the cathodically deposited copper is commercially pure except for the usual impurities and unavoidable minor amounts of electrolyte (sulphates) physically present on the surface of the cathodes or occluded therein, the copper cathodes generally are not used per se because of their shape and physical properties, especially the grain structure of the deposited copper. To place them in more useful form, the cathodes must be melted and the molten metal cast into one or more semi-finished forms—for example, cakes, ingots, bars such as wire bars, billets and rods and similar shapes from which finished products are produced, such as for example, sheets, wire, tubes and the many other commercial products fabricated of commercially pure copper. However, it is important that the copper not become contaminated with commercially unacceptable amounts of oxygen and sulphur during the melting since from a commercial standpoint the melted . copper is essentially ruined and must be reprocessed through a series of steps to form a new cathode. This is a costly and time consuming procedure.

It is essential therefore, that the burners used to melt the copper not contaminate the copper with, for example, unwanted oxygen. In general, the fuel/oxygen (air) mixture is proportioned to contain insufficient oxygen to completely burn the fuel and the resulting melting flame is a reducing flame. For most industrial uses, the predetermined reducing conditions should be such that any oxygen incorporated into the copper is less than 0.05% by weight of the copper during the melting. Preferably, the predetermined reducing conditions are such that less than 0.035% and most preferably less than 0.01% by weight of oxygen are incorporated into the molten copper.

The burners described in Phillips et al. supra and U.S. Pat. No. 4,536,152 to Little and Thomas were specially designed to provide a high degree of fuel/air mixing to produce a uniform reducing flame to minimize unburned oxygen and possible copper contamination. The disclosure of U.S. Pat. No. 4,536,152 is hereby incorporated by reference.

While the prior art burners per se are important in the melting of copper, it is also very important to properly control the fuel/air mixture since an excess of fuel or air may produce a flame which will contaminate the copper and it is therefore an object of the present invention to provide a method for effectively melting copper and other metals and materials by controlling the fuel/air ratio of the burners used for the melting operation.

The predominant furnace for melting copper is the vertical shaft furnace using multiple burners as described in the Phillips et al. patent, supra., and the following description will be directed to this furnace for convenience.

SUMMARY OF THE INVENTION

It has now been discovered that fuel and air (oxygen) fed to burners used to melt, for example, cathode copper, may be effectively controlled to provide a fuel/air ratio within desired operating limits to produce, for example, a reducing flame having a hydrogen content of the combusted fuel at about by volume ±0.3% or less of the desired hydrogen value. The hydrogen value is usually maintained at between about 1% -3% by volume depending on the fuel used. Using natural gas the hydrogen content is about 1-2% whereas for propane the hydrogen content is about 0.3-0.9% because of the carbon-hydrogen ratio of the fuel, more CO being formed than $H_2$ for propane whereas with (natural gas) methane, equal parts of $H_2$ and CO are formed.

Broadly stated, the procedure for controlling a number of burners, e.g., around the periphery of a shaft furnace, comprises the steps:

(a) predetermining for a particular material (e.g., hydrogen) the set point amount (content) desired for each burner;

(b) sampling one burner's fuel-air mixture for analysis while fuel/air gas mixtures of the other burners are being drawn from each burner into a manifold;

(c) measuring the amount of the material in the sample;

(d) comparing the sampled amount with the predetermined desired amount;

(e) changing, if necessary, the amount of fuel and/or air; and (f) repeating steps (b)-(e) for the other burners and continuing the steps (b)-(e) during the melting operation.

DETAILED DESCRIPTION OF THE INVENTION

Figure 1:
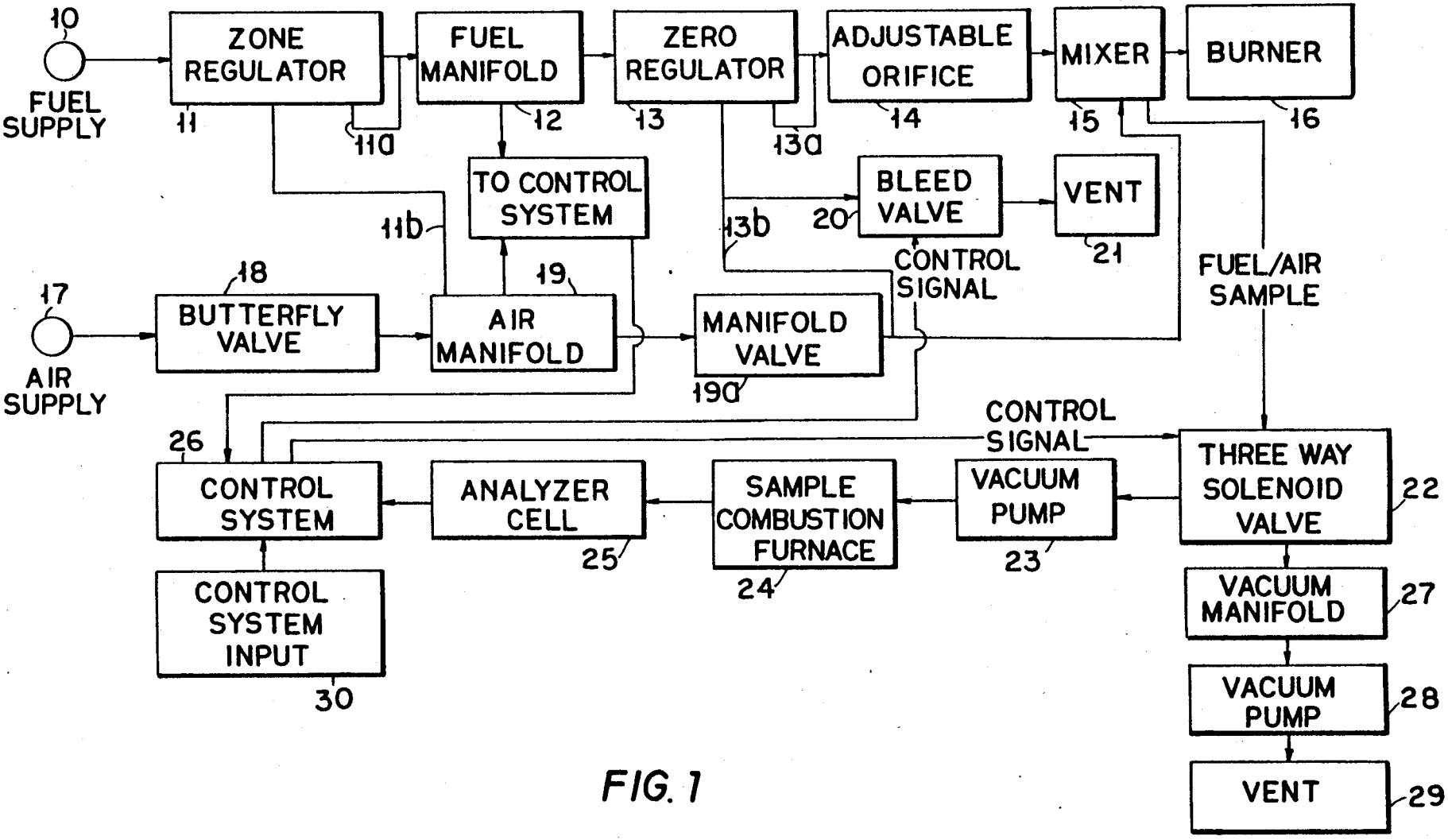
FIG. 1 is a diagram of apparatus according to the principles and teachings of the present invention.

The vertical (shaft) furnace may be any generally vertically disposed furnace of a desired shape or size which will support a column of any desired size and shape of the copper to be melted and allow the column, assisted by gravity, to move downwardly in the furnace as the copper is melted from the column. Thus, for example, the furnace may be generally square, rectangular or preferably circular in shape.

The furnace may be constructed in any desired manner of any desired material. Preferably, the side walls and bottom of the furnace are fabricated into a substantially gas-tight steel shell, as by welding, and the shell lined with an acid, neutral or basic refractory; a high alumina refractory being preferred.

In practicing the invention, the melting stream (flame) may be injected into the furnace as one or as a plurality of streams at one or a plurality of points or zones in the furnace and the uniting of the fuel and oxygen-containing gas may be accomplished in one or a plurality of steps. Also, ignition of the united stream or streams may be initiated at any time after the uniting step or steps and before the united stream or streams contact the copper to be melted. Thus, for example, the melting stream may be united in a single step and then delivered to a plurality of burners and ignited therein prior to injection into the furnace. While such a procedure may be used it is not one of the more preferred procedures because of the possibility of flash-back occurring in the melting stream. Likewise, the melting stream may be united in a single step and then burned and the hot products of combustion may then be delivered to a plurality of inlet ports in the furnace. While such a procedure may be used, it also is not one of the more preferred procedures since it would require the use of relatively long refractory conduits capable of withstanding extremely high temperatures. Preferably, the melting stream is composed of a plurality of unit streams each of which is injected into the furnace from its own burner body mounted on the furnace wall, each of the unit streams being ignited in its particular burner body and then injected into the furnace. In the most preferred procedure, a stream of fuel and a stream of the oxygen-containing gas are separately delivered to each burner body, each of which is provided with a uniting (mixing) section for receiving and uniting the separately delivered streams of fuel and the oxygen containing gas and then delivering the unit stream to an immediately adjacent burner section in the burner body wherein the unit stream is ignited and then injected into the furnace.

The burner or burners may be mounted in the furnace walls so that the gases discharged therefrom are aimed directly at, or generally tangentially to, the column of copper; direct discharge being preferred inasmuch as it has been found to provide a high melting rate. Preferably, a plurality of burners are mounted in the furnace walls in at least one bank in spaced relationship to each other about the furnace perimeter adjacent the bottom of the furnace. Preferably, such bank contains at least three burners. More preferably, a plurality of burners are mounted in the furnace walls in each of a plurality of banks with the burners in each bank in spaced relationship to each other about the furnace perimeter and each bank in spaced vertical relationship to each other with the lowermost bank adjacent the furnace bottom. This latter arrangement of the burners, especially in combination with inwardly sloping furnace walls in the bottom portion of the furnace is more preferred since it has been found that it assists in causing the bottom portion of the melting column of copper to assume a generally tapered shape, which in the case of a round furnace is a generally conical shape, such shape having also been found to provide a higher melting rate than would otherwise be obtained in its absence.

In addition, it has been found that, under any given conditions, the amount of heat absorbed by the copper as convection heat from the gases is dependent upon the temperature of the gases impinging upon the column and that increased temperature in the impinging gas increased the amount of heat that is absorbed by the copper as convection heat. Preferably, at least the stream of the oxygen-containing gas and more preferably also the fuel stream, are preheated as much as practicable. Preferably also where such gases are preheated, they are preheated to a temperature in the range of 150° to 540° C. In the most preferred procedure, at least the stream of the oxygen-containing gas is preheated by indirect contact with the hot flue gases from the furnace.

In general, the furnace is operated by adding copper to the top of the column as needed and the molten copper may be collected in a pool in the bottom of the furnace and tapped therefrom either continuously or intermittently through the tap hole. Preferably, no pool is employed and the molten metal is allowed to flow freely through an open tap hole as fast as the copper melts in the furnace. The molten metal from the furnace may be delivered in any suitable manner to any desired location for further use. Preferably, the metal is allowed to flow from the tap hole into a heated launder which delivers it directly to casting means located adjacent the furnace or to a holding furnace from which holding furnace it may be delivered to appropriate casting means. The heated launder and/or holding furnace may be heated using burners which are connected to the same burner control system used to control the furnace burners for melting the copper.

Any fuel, especially any fluid or fluidized fuel may be used in practicing the invention. Preferably, the fuel is a fuel comprising hydrogen and carbon monoxide, such as for example, water gas or producer gas, or the fuel is a hydro-carbonaceous fuel (i.e. a fuel comprising carbon and hydrogen). Natural gas is the most preferred fuel. When the preferred fuels are employed in practicing the invention to produce reducing constituents in the furnace atmosphere proper these will consist essentially of hydrogen and carbon monoxide as a result of the incomplete burning of the fuel. In general, the hydrogen amount is controlled by analyzing a combusted sample of the fuel and air and adjusting the fuel/air ratio to achieve the desired hydrogen amount. Regardless of the fuel used however, the method of the invention controls the predetermined set point amount of a desired material (e.g., hydrogen, CO, $O_2$, $N_2$, $H_2O$, etc.) to within about ±0.3% by volume and usually to less than ±0.2% or ±0.1% by volume.

Referring to FIG. 1, there is shown a typical diagram of a single burner system. It should be appreciated as discussed hereinabove that there would usually be multiple burners in rows around the periphery of the furnace and each burner would use the same configuration of equipment as described in FIG. 1.

Fuel, such as natural gas, is fed from the fuel supply 10 to a zone regulator 11 to maintain a positive fuel pressure over the air pressure. The zone regulator has two tubes 11*a* and 11*b* which communicate with the fuel line and air manifold 19, respectively, to accomplish this positive pressure condition. The fuel then goes into a fuel manifold 12 and is fed to a zero regulator conventional diaphragm controlled valve 13. The valve 13 is also provided with tube 13*a* and tube 13*b* leading from the air line to the space above the diaphragm in the valve 13 so as to communicate the pressure of the air to the diaphragm. Tube 13*b* also has a bleed valve 20 and vent 21 associated therewith to adjust the amount of fuel or air based on the control system 26 as discussed hereinbelow. A preferred embodiment utilizes a motorized bleed valve 20 to provide accurate control over the fuel/air ratio, which motorized control vis-a-vis pressure control has been found to be very important in obtaining the excellent operating results achieved by the invention.

The fuel is then fed through an adjustable orifice 14 which serves to also adjust the amount of fuel fed to the burner. Usually, the adjustable orifice 14 is a gross manual adjustment for the fuel flow with the bleed valve 20 providing the final fine adjustment needed for close control of the fuel/air ratio. The fuel then goes into a mixing chamber 15 (usually part of the burner) to be mixed with the air.

Air is fed from air supply 17 through a butterfly valve 18 to air manifold 19 and through manifold valve 19*a* into mixer 15. The mixed fuel/air stream is fed into the burner 16 for combustion.

The ratio of fuel to air is preferably determined by taking a sample of the mixed fuel/air stream, burning it and analyzing the combustion products. Other means of sampling and analysis may be employed. This may be accomplished by using a three-way solenoid valve 22. With the valve 22 directed for sampling and analysis, the fuel/air mixture is fed through vacuum pump 23 to furnace 24 which burns the mixture under ideal conditions. This burnt mixture is then fed into analyzer cell 25 for analysis and the results inputted to control system 26. Depending on the analysis, an adjustment is made to the bleed valve 20 by decreasing the opening of the valve if more fuel is needed or increasing the opening of the valve if more air is needed. Other inputs to the control system 26 are the air pressure and fuel pressure from their respective manifolds.

When the fuel/air mixture is not being sampled for analysis, the solenoid valve 22 directs the mixture to a vacuum manifold 27 connected to a vacuum pump 28 and vent 29.

For the typical burner system having multiple burners in a row around the periphery of the furnace, each burner will have the same configuration from the fuel manifold 12 and air manifold 19 to the burner. Each burner will also have a three way solenoid valve associated therewith and the remaining equipment downstream from the solenoid valve will be used for all the burners regardless of the number of burners. Thus, for example, only one furnace 24 is generally used for the row of burners. Multiple furnaces, analyzer cells, etc. may be employed but this is not generally economical.

Figure 2:
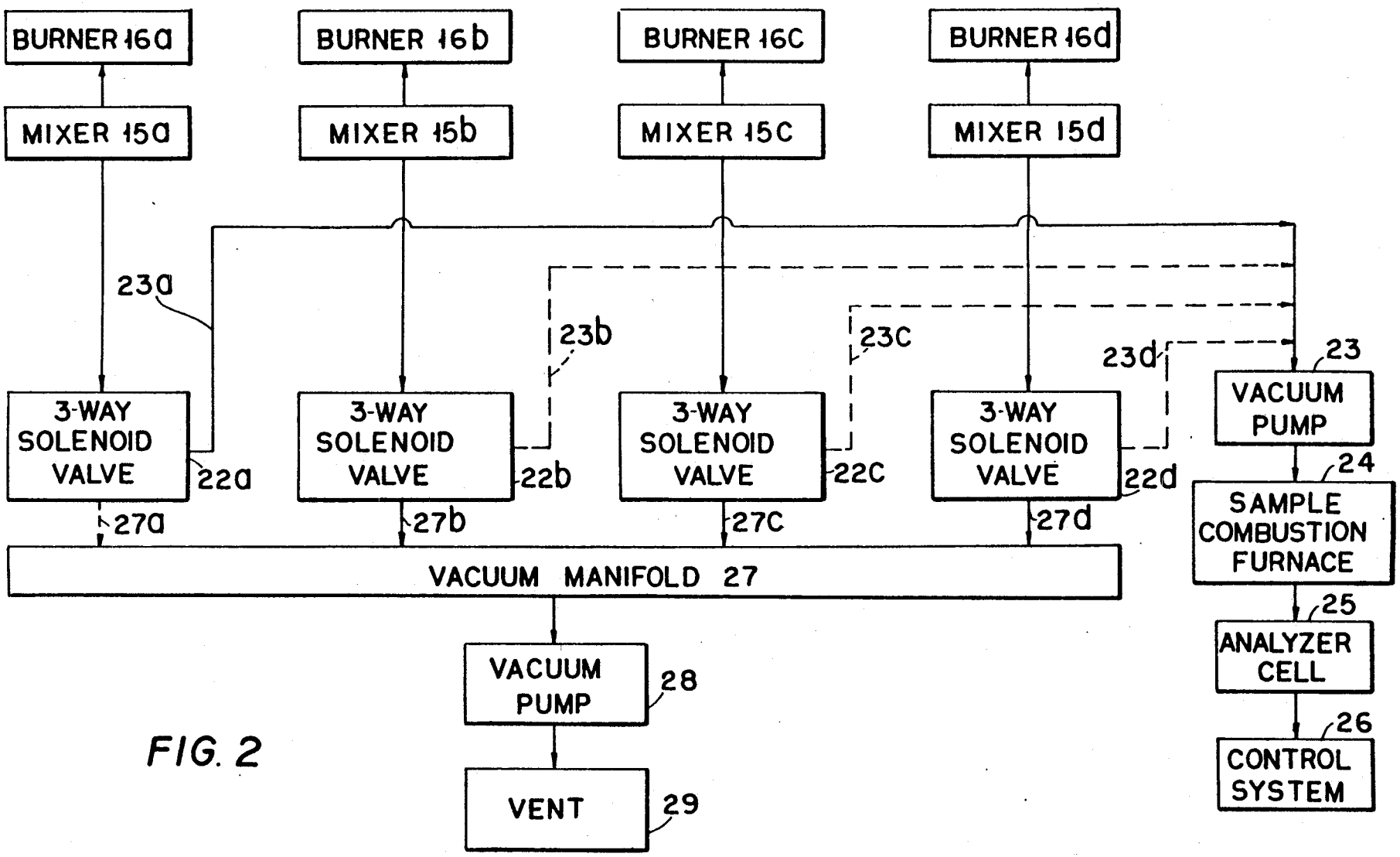
FIG. 2 is a diagram of apparatus showing the fuel/air mixture sampling system for a multiple burner shaft furnace.

Referring to FIG. 2 which shows a shaft furnace having four (4) burners, in operation, a sample from mixer 15*a* will be taken and directed by valve 22*a* through line 23*a* to vacuum pump 23. From pump 23, the sample is burned in furnace 24, analyzed in cell 25 and the results inputted to control system 26. It is an important feature of the invention that while the gas mixture from mixer 15*a* is being sampled and analyzed, valves 22*b*, 22*c* and 22*d* are respectively, to vacuum manifold 27 by vacuum pump 28 and vented (29). When the sample from mixer 15*a* is analyzed and processed by control system 26, valve 22*a* is changed to direct the gas from mixer 15*a* to vacuum manifold 27 through line 27*a* and valve 22*b* changed to permit the gas mixture from mixer 15*b* to be sampled and analyzed by passing the sample through line 23*b* to the vacuum and analyzing system. Valves 22*c* and 22*d* remain as described above and their respective gas mixtures are fed into the vacuum manifold 27. The above procedure is repeated continually during operation of the furnace with all the burners being sampled repeatedly. Any sequence of sampling may be employed.

The above sampling and analyzing procedure significantly increases the number of samples and analyses per unit of time since a gas mixture sample is always available to be analyzed near the furnace 24 and cell 25 due to the use of the vacuum manifold 27. This can readily be understood by noting the distance a gas sample would have to travel from the mixer 15 to the sample combustion furnace 24 since the distance from the mixer 15 to the valve 22 is eliminated. In normal commercial operation the amount of samples and analysis are approximately doubled when compared to a system not using the vacuum manifold 27. This increase in sampling and analysis enables close control of the fuel/air ratio and consequent increased efficiency of the melting operation.

In a commercial operation melting copper cathodes using a shaft furnace having three rows of multiple burners, control of the fuel/air ratio using the method of the invention (including motorized bleed valves 20) resulted in significantly enhanced product quality because of the controlled hydrogen amounts in the burner flame (less than ±0.2% variance by volume from the desired hydrogen set points). Melting operations not using the invention had hydrogen amounts varying by ±0.5% from the desired concentration set points.

It will be apparent that many changes and modifications of the several features described herein may be made without departing from the spirit and scope of the invention. It is therefore apparent that the foregoing description is by way of illustration of the invention rather than limitation of the invention.

We claim:

1. A method for controlling the fuel/air ratio for each burner in a multiple burner system comprising:

(a) predetermining for each burner a set-point amount for at least one of the materials selected from the group consisting of fuel, air and components and/or combustion products thereof;

(b) sampling for analysis one of the burner's fuel-air mixture to be burned while the fuel/air gas mixtures of the other burners are being drawn from each respective burner into a manifold;

(c) analyzing the sampled fuel/air mixture for the selected material or materials;

(d) comparing the sampled analyzed amount with the predetermined set-point desired amount for the sampled burner;

(e) changing, if necessary, the amount of fuel or air for the sampled burner; and (f) repeating steps (b)–(e) for the other burners and continuing the steps (b)–(e) during use of the burners.

2. The method of claim 1 wherein the burners are on a shaft furnace having a row burners around the periphery of the furnace.

3. The method of claim 2 wherein the furnace is used to melt copper.

4. The method of claim 3 wherein the material measured is hydrogen.

5. The method of claim 4 wherein the fuel or air amounts are changed by using a motorized bleed valve to adjust the amount of fuel or air flowing in the system.

* * * * *